US010118418B2

(12) United States Patent
Yoshida et al.

(10) Patent No.: US 10,118,418 B2
(45) Date of Patent: Nov. 6, 2018

(54) MEDIUM FEEDING APPARATUS, PRINTING APPARATUS, AND CONTROL METHOD OF MEDIUM FEEDING APPARATUS

(71) Applicant: SEIKO EPSON CORPORATION, Tokyo (JP)

(72) Inventors: Hiroshi Yoshida, Shiojiri (JP); Toru Hayashi, Suwa (JP); Ryo Hamano, Matsumoto (JP); Jun Ushiama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/462,537

(22) Filed: Mar. 17, 2017

(65) Prior Publication Data

US 2017/0282605 A1 Oct. 5, 2017

(30) Foreign Application Priority Data

Mar. 31, 2016 (JP) ..... 2016-070420

(51) Int. Cl.
*B41J 29/38* (2006.01)
*B41J 13/00* (2006.01)

(52) U.S. Cl.
CPC ..... *B41J 13/0009* (2013.01)

(58) Field of Classification Search
USPC ..... 347/16, 104, 105
See application file for complete search history.

(56) References Cited

U.S. PATENT DOCUMENTS

2009/0269119 A1* 10/2009 Hatada ..... B41J 11/001 400/618

FOREIGN PATENT DOCUMENTS

JP 2010-111057 5/2010

* cited by examiner

*Primary Examiner* — Lam Nguyen
(74) *Attorney, Agent, or Firm* — Workman Nydegger

(57) ABSTRACT

A medium feeding apparatus includes a roll holding portion which holds a roll body around which a printing medium is wound, a feeding roller which pulls out the printing medium from the roll body and feeds the printing medium, a roll motor which rotates the roll body held by the roll holding portion, a roll motor control portion which controls the roll motor, and rotation position detecting portions which detect a rotation position of the roll body, the roll motor control portion performs removing looseness of the printing medium pulled out from the roll body by driving the roll motor and rotating the roll body in a rewinding direction, and in the removing, driving of the roll motor is finished on the basis of movement of the rotation position detected by the rotation position detecting portions.

13 Claims, 5 Drawing Sheets

MEDIUM FEEDING APPARATUS, PRINTING APPARATUS, AND CONTROL METHOD OF MEDIUM FEEDING APPARATUS

BACKGROUND

1. Technical Field

The present invention relates to a medium feeding apparatus which feeds a medium such as a printing medium, a printing apparatus, and a control method of the medium feeding apparatus.

2. Related Art

In the related art, as a printing apparatus, a roll body mounting portion in which a roll body around which a medium (paper) is wound is mounted, a pair of transporting rollers which transports the medium pulled out from the roll body, a printing head which performs printing on the medium, a roll motor (RR motor) which rotates the roll body, and a control portion which controls the roll motor, is known (refer to JP-A-2010-111057). Before a printing process, the printing apparatus performs a looseness removing process in which looseness of the medium pulled out form the roll body is removed by driving the roll motor and rotating the roll body in a rewinding direction. At this time, in the printing apparatus, the roll motor is continuously driven at a certain time, and driving of the roll motor is finished on the basis of a driving time as a trigger.

However, in the looseness removing process of the printing apparatus of the related art, since driving of the roll motor is finished on the basis of the driving time of the roll motor as a trigger, even after looseness of the medium is removed, the roll motor is continuously driven until the driving time of the roll motor reaches a target driving time. Therefore, the roll motor is continuously driven more than necessary, and thus there is a problem in that the roll motor is excessively heated.

SUMMARY

An advantage of some aspects of the invention is to provide a medium feeding apparatus which is capable of suppressing heat generation of a roll motor as much as possible, a printing apparatus, and a control method of the medium feeding apparatus.

According to an aspect of the invention, there is provided a medium feeding apparatus including a holding portion that holds a roll body around which a medium is wound, a medium feeding portion that pulls out the medium from the roll body and feeds the medium, a roll motor that rotates the roll body held by the holding portion, a control portion that controls the roll motor, and a rotation position detecting portion that detects a rotation position of the roll body, in which, the control portion performs removing looseness of the medium pulled out from the roll body by driving the roll motor and rotating the roll body in a rewinding direction, and in the removing, driving of the roll motor is finished on the basis of movement of the rotation position detected by the rotation position detecting portion.

In this case, in the removing, it is preferable that determination whether or not the roll body is unmoved is made by the movement of the rotation position be performed, and when the roll body is determined to be unmoved, driving of the roll motor be finished.

According to another aspect of the invention, there is provided a printing apparatus including the medium feeding apparatus described above, and a printing portion that performs printing on a medium being fed by the medium feeding apparatus.

According to still another aspect of the invention, there is provided a control method of the medium feeding apparatus, which includes a holding portion that holds a roll body around which a medium is wound, a medium feeding portion that pulls out the medium from the roll body and feeds the medium, and a roll motor that rotates the roll body held by the holding portion, the method includes performing removing looseness of the medium pulled out from the roll body by driving the roll motor and rotating the roll body in a rewinding direction, and finishing driving of the roll motor based on movement of a rotation position of the roll body in the removing.

According to this configuration, in the removing, since driving of the roll motor is finished on the basis of the movement of the rotation position of the roll body as a trigger, the looseness of the printing medium disappears, and driving of the roll motor can be finished at a timing when the roll body is not rotated (or rotation of the roll body is reduced). Accordingly, a situation in which the roll motor is continuously driven more than necessary can be avoided, and heat generation of the roll motor can be suppressed as much as possible. Therefore, a situation in which temperature of the roll motor exceeds allowable temperature can be avoided as much as possible. In addition, when the heat generation of the roll motor is suppressed as much as possible, the roll motor having low allowable temperature can be used.

In the medium feeding apparatus, it is preferable that, in the removing, when a maximum value of the detected rotation position is not changed at a certain time, the roll body be determined to be unmoved.

According to the configuration, when the determination is performed using the maximum value of the rotation position, a situation in which erroneous determination is generated due to an influence of hunting can be avoided.

In addition, it is preferable that, in the removing, determination whether or not the roll body is unmoved start when the current rotation position of the roll body exceeds the rotation position at the time of starting the removing in the rewinding direction.

According to the configuration, even when the roll body is being rotated in the unwinding direction at the time of starting the removing, after influence of rotation in the unwinding direction disappears, determination of finish of driving (determination whether or not the roll body is unmoved) can be started. Therefore, a situation in which erroneous determination is generated in the determination of finish of driving due to the influence of rotation in the unwinding direction can be avoided.

In the printing apparatus, it is preferable that the control portion perform removing in every line feed operation.

According to the configuration, each line feed operation can be performed with high accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, with reference to attached drawings, a medium feeding apparatus, a printing apparatus, and a control method of the medium feeding apparatus according to an embodiment of the invention will be described. In the embodiment, a large format printer for which the medium feeding apparatus, the printing apparatus, and a control method of the medium feeding apparatus of the invention are applied is exemplified. While a large printing medium (medium) is pulled out from a roll body and is fed, the large format printer (printing apparatus) performs printing in an ink jet manner on the fed large printing medium. Particularly, in the large format printer, at the time of performing the looseness removing process when looseness of the printing medium pulled out from the roll body, heat generation of the roll motor can be suppressed as much as possible. The roll body set in the large format printer is a roll body in which a long printing medium is wound around a cylindrical core in a roll shape. In addition, the printing medium is recording paper, films, cloths, or the like.

Figure 1:
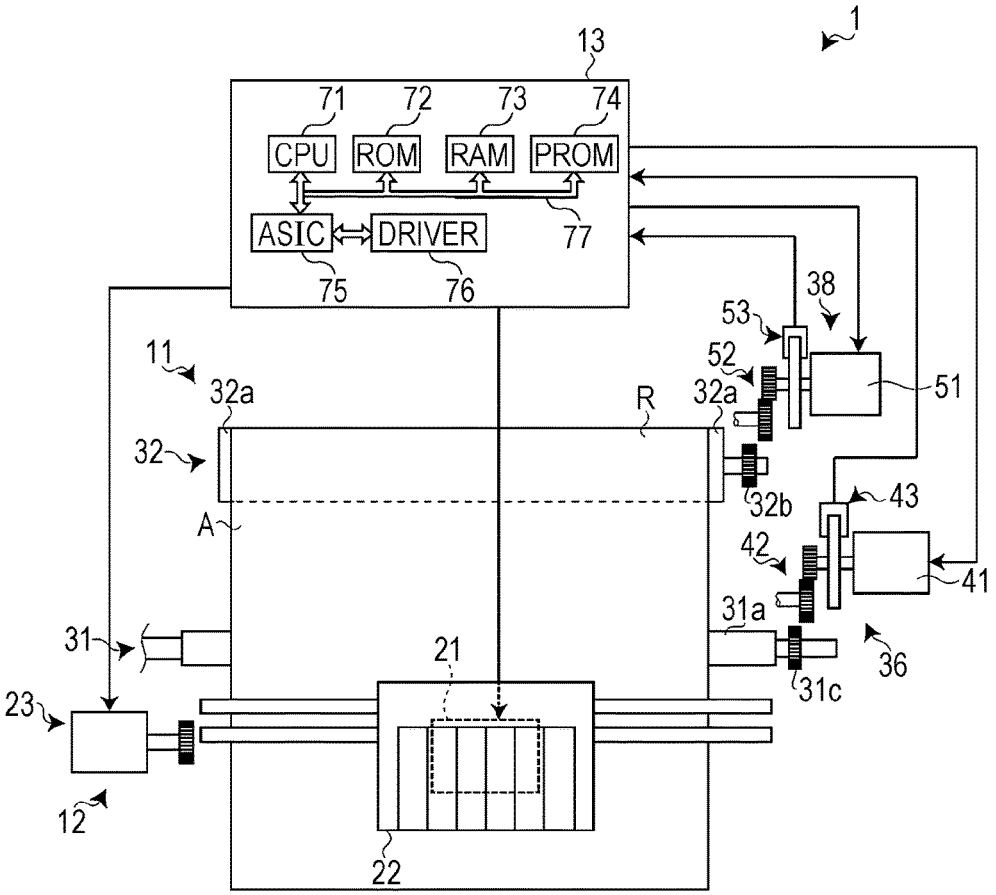
FIG. 1 is a plan view illustrating a schematic configuration of a large format printer according to an embodiment of the invention.
Figure 2:
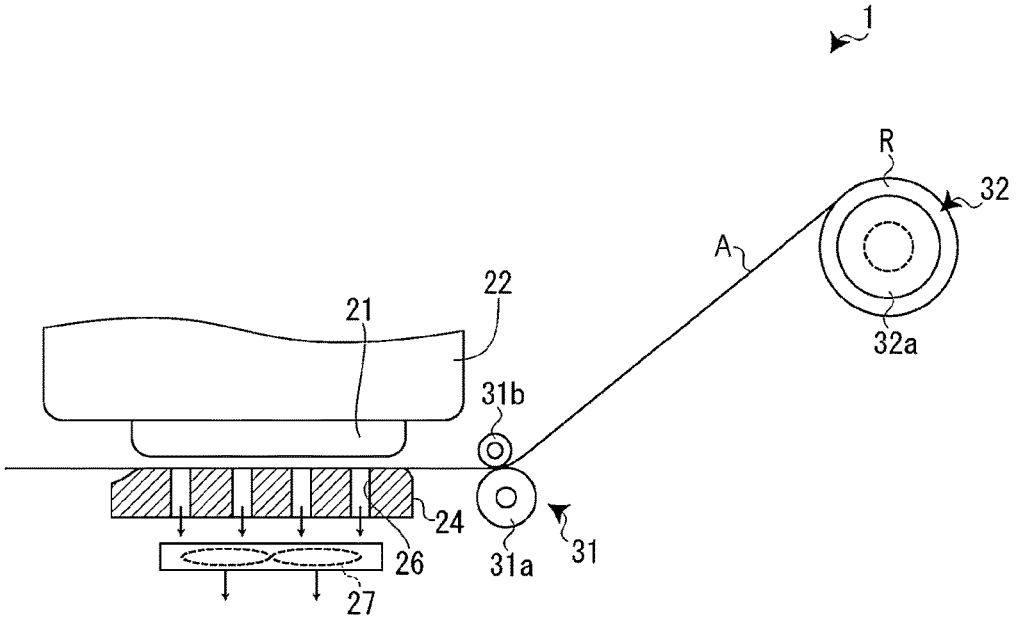
FIG. 2 is a side view illustrating a schematic configuration of the large format printer.

As illustrated in FIG. 1 and FIG. 2, a large format printer 1 is provided with a medium feeding mechanism 11 which feeds a printing medium A in a transporting paper direction, a printing mechanism 12 (printing portion) which performs printing on the printing medium A being fed by the medium feeding mechanism 11, and a controller 13 which controls these mechanisms. The large format printer 1 performs printing on the printing medium A in a serial printing manner by repeating a line feed operation by the medium feeding mechanism 11 and a printing operation by the printing mechanism 12. Also, the "medium feeding apparatus" is configured with the medium feeding mechanism 11 and the controller 13.

The printing mechanism 12 performs printing on the printing medium A being fed by the feeding roller 31 to be described later, and is provided with a printing head 21, a carriage 22 on which the printing head 21 is mounted, a reciprocating mechanism 23 which reciprocates the printing head 21 through the carriage 22, and a platen 24 against the printing head 21. Also, the printing mechanism 12 may be configured with a plurality of the printing heads 21, and may be configured with one printing head 21.

The printing head 21 includes a nozzle row (not illustrated) extending in the transporting paper direction of the printing medium A by the medium feeding mechanism 11, and discharges ink from a plurality of discharging nozzles of the nozzle row in a ink jet manner. Meanwhile, the reciprocating mechanism 23 reciprocates the printing head 21 in an intersecting direction with respect to the transporting paper direction. Also, the printing mechanism 12 performs the printing operation with respect to the printing medium A by driving the printing head 21 while the printing head 21 is moved forward and backward by the reciprocating mechanism 23.

Meanwhile, a plurality of suction holes 26 for vertically penetrating are formed in the platen 24. In addition, a suction fan 27 is provided under the platen 24. Also, when the suction fan 27 is operated, an inside of the suction hole 26 is negatively pressurized and the printing medium A on the platen 24 is sucked and held. In the embodiment, the printing operation with respect to the printing medium A is performed, in a state in which the printing medium A is sucked and held on the platen 24.

The medium feeding mechanism 11 is provided with a roll holding portion 32 (holding portion) which holds the roll body R around which the printing medium A is wound, and a feeding roller 31 (medium feeding portion) which pulls out the printing medium A from the roll body R and feeds the medium. In addition, the medium feeding mechanism 11 is provided with a roll driving portion 38 which rotatably drives the roll body R, and a feeding roller driving portion 36 which drives the feeding roller 31.

The feeding roller 31 is configured with a nip roller configured with a driving roller 31*a* and a driven roller 31*b*. That is, the driving roller 31*a* and the driven roller 31*b* of the feeding roller 31 pinches the printing medium A therebetween and rotatably feeds the medium.

The feeding roller driving portion 36 is provided with a feeding motor 41 which is a power source, a feeding gear train 42 which transfers the power of the feeding motor 41 to the feeding roller 31, and a feeding rotation detecting portion 43 which detects a rotation position of the feeding roller 31. The feeding motor 41 is, for example, a DC motor. In addition, the feeding gear train 42 is connected to the feeding input gear 31*c* provided in the driving roller 31*a*. Also, when the power from the feeding motor 41 is transferred to the feeding input gear 31*c* through the feeding gear train 42, the driving roller 31*a* is rotated, and according to this, the driven roller 31*b* is rotated. As described above, the feeding roller 31 is rotatably driven by the power of the feeding motor 41.

The feeding rotation detecting portion 43 detects the rotation position of the driving roller 31*a*. Specifically, the feeding rotation detecting portion 43 is configured with a rotary encoder which is provided with a disc shaped scale and a photo interrupter provided in an output shaft of the feeding motor 41. That is, the feeding rotation detecting portion 43 detects the rotation position of the driving roller 31*a* by detecting the rotation position of the output shaft of the feeding motor 41.

The roll holding portion 32 is provided with a pair of rotation holders 32*a* holding the roll body R, and a holder supporting portion (not illustrated) which freely rotates and supports each of the pair of the rotation holders 32*a*. The pair of rotation holders 32*a* is inserted into both ends of a core of the roll body R, and holds the roll body R from the both ends. In addition, one of the pair of rotation holders 32*a* includes a roll inputting gear 32*b* receiving the power from the roll driving portion 38.

The roll driving portion 38 is provided with a roll motor 51 which is power source, a roll gear train 52 which transfers the power of the roll motor 51 to the rotation holder 32*a*, and a roll rotation detecting portion 53 which detects the rotation position of the roll body R. The roll motor 51 is, for example, a DC motor. In addition, the roll gear train 52 is connected to the roll inputting gear 32*b* of the rotation holder 32*a* holding the roll body R. Also, when the power from the roll motor 51 is transferred to the roll inputting gear 32*b* through the roll gear train 52, the rotation holder 32*a* in which the roll inputting gear 32*b* is provided is rotated, and the roll body R which is held by the holder is rotated. Accordingly, the roll body R is rotated by the power of the roll motor 51.

In addition, the roll motor 51 is capable of being forwardly rotated, and the roll body R is capable of being rotated in an unwinding direction and a rewinding direction. In the embodiment, the roll body R is rotated in the unwinding direction by forwardly rotating the roll motor 51, and the roll body R is rotated in the rewinding direction by reversely rotating the roll motor 51. The unwinding direction is a rotation direction in which the printing medium A is unwound from the roll body R, and the rewinding direction is a rotation direction in which the printing medium A is rewound to the roll body R. Details will be described later, in the line feed operation described above, the feeding roller 31 assists paper feeding by rotating the roll body R in the unwinding direction, and in the looseness removing process, looseness of the printing medium A is removed by rotating the roll body R in the rewinding direction.

The roll rotation detecting portion 53 detects the rotation position of the roll body R. Specifically, the roll rotation detecting portion 53 is configured with a rotary encoder including a disc shaped scale and the photo-interrupter provided in an output shaft of the roll motor 51. That is, the roll rotation detecting portion 53 detects the rotation position of the roll body R by detecting the rotation position of the output shaft of the roll motor 51.

The controller 13 controls the large format printer 1 overall. Specifically, the controller 13 is provided with a central processing unit (CPU) 71, a read only memory (ROM) 72, a random access memory (RAM) 73, a programmable ROM (PROM) 74, an application specific integrated circuit (ASIC) 75, a motor driver 76, and a bus 77. In addition, in the controller 13, each pulse signal from the feeding rotation detecting portion 43 and the roll rotation detecting portion 53 is input.

In the large format printer 1 configured as described above, when receiving an execution instruction of printing job, printing operation (main scanning) by the printing mechanism 12 and line feed operation (sub scanning) in which the printing medium A is fed as a printing width of the printing mechanism 12 by the medium feeding mechanism 11 are alternately repeated, and thus a printing image is formed on the printing medium A.

Figure 3:
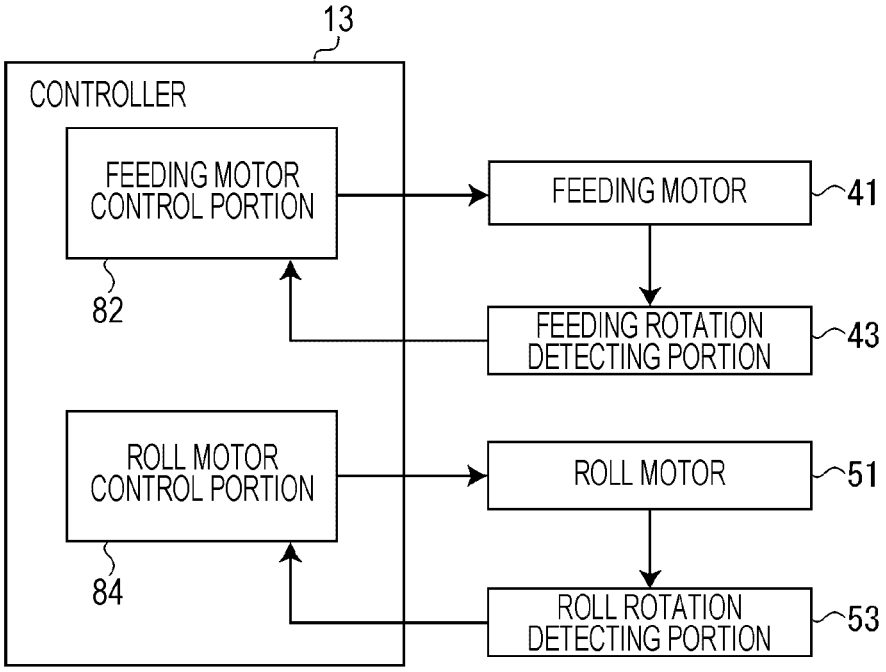
FIG. 3 is a block diagram illustrating a functional configuration of a controller.

Next, with reference to FIG. 3, a functional configuration of the controller 13 will be described. As illustrated in FIG. 3, the controller 13 is provided with a feeding motor control portion 82 and a roll motor control portion 84 (controller). Each of these functional portions is realized when a hardware constituting the controller 13 is cooperated with a software stored in a memory such as the ROM 72.

The feeding motor control portion 82 drives and controls the feeding motor 41 by pulse width modulation (PWM) controlling through the motor driver 76. The feeding motor control portion 82 outputs a duty value, which is PID-controlled, to the motor driver 76, based on rotation speed or a rotation position of the driving roller 31*a* detected by the feeding rotation detecting portion 43.

The roll motor control portion 84 drives and controls the roll motor 51 by PWM controlling through the motor driver 76. At the time of performing the line feed operation, the roll motor control portion 84 forwardly rotates the roll motor 51 so that tension being applied to the printing medium A between the feeding roller 31 and the roll body R becomes a predetermined tension. Accordingly, it assists transportation of paper by the feeding roller 31. Specifically, the roll motor control portion 84 performs a calculation process for obtaining a motor output value and outputs the calculated motor output value to the motor driver 76.

In the calculation process, as Expression (1), basically, a motor output value Dx is obtained by subtracting Duty(f), which is a duty value (hereinafter, refer to as "tension control value") necessary for applying a predetermined tension F to the printing medium A between the intermediate roller 31 and the roll body R, from a Duty(ro), which is a duty value necessary for rotating the roll body R at the rotation speed V.

$$Dx = \text{Duty}(ro) - \text{Duty}(f) = a \times V + b - \frac{\frac{F \times r}{M}}{Ts} \times \text{Duty}(\max) \tag{1}$$

Here, r is a radius of the roll body R, M is a reduction ratio by the roll gear train 52, Duty(max) is a maximum value of the duty value, Ts is a starting torque of the roll motor 51, and a and b are coefficients calculated in advance. The coefficients a and b are calculated by solving a simultaneous equation relating to the coefficients a and b obtained, when a duty value Duty(ro)_l at the time of rotating the roll body R at low rotation speed Vl and a duty value Duty(ro)_h at the time of rotating the roll body R at high rotation speed Vh are acquired, and these values are substituted to Expression (2).

$$\text{Duty}(ro) = a \times V + b \tag{2}$$

In addition, the roll motor control portion 84 reversely drives the roll motor 51 at the time of performing the looseness removing process. Here, refer to FIG. 4, the looseness removing process (looseness removing step) will be described.

Figure 4:
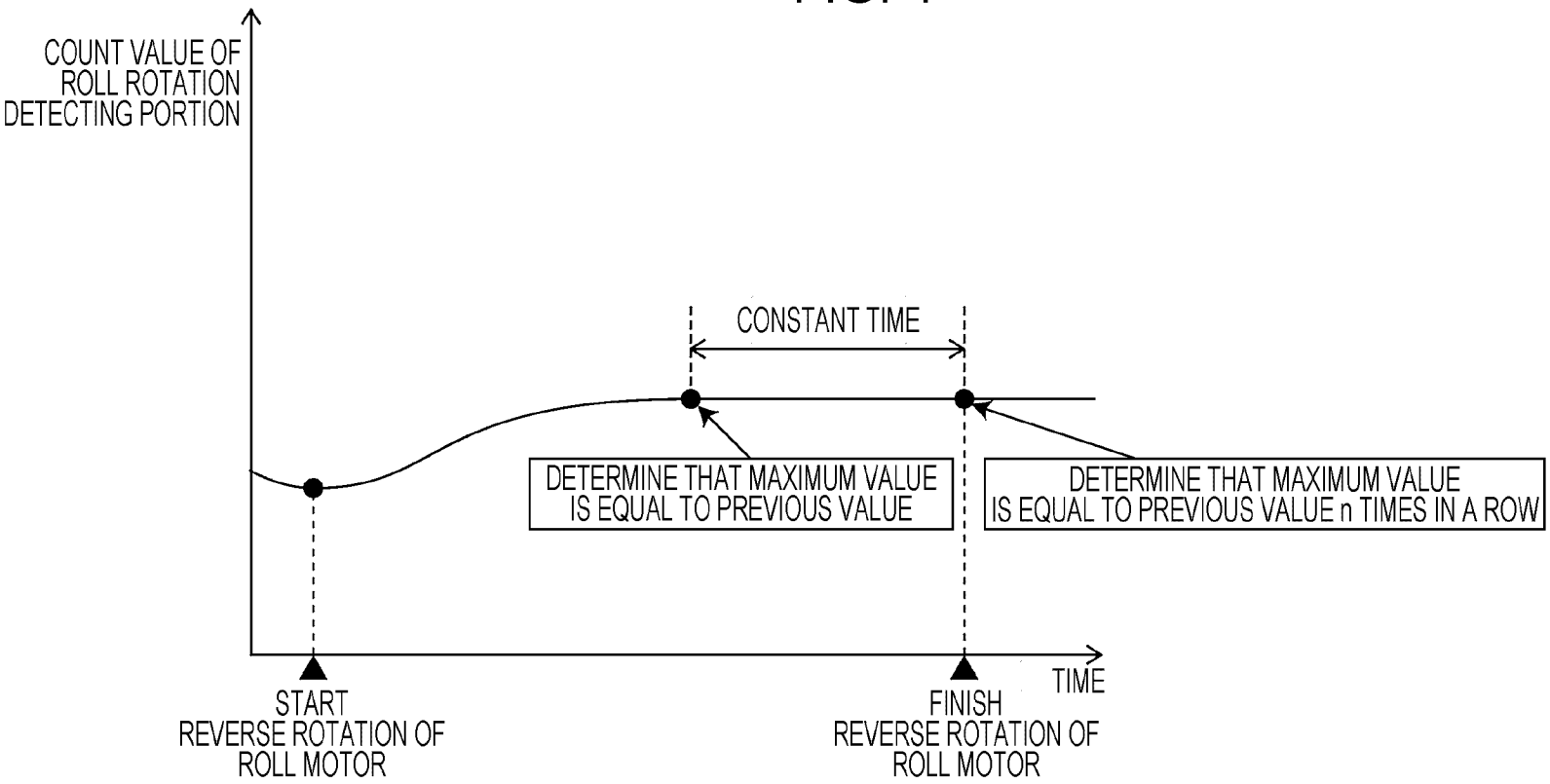
FIG. 4 is a graph illustrating a looseness removing process.

The looseness removing process is performed in every line feed operation, and is performed before a subsequence line feed operation, after the line feed operation. In the looseness removing process, the roll motor control portion 84 rotates the roll body R in the rewinding direction by reversely rotating the roll motor 51. Accordingly, the printing medium A pulled out from the roll body R, that is, looseness of the printing medium A between the feeding roller 31 and the roll body R is removed. Also, as illustrated in FIG. 4, in the looseness removing process, during driving the roll motor 51, the rotation position P of the roll body R is regularly detected, and the detected rotation position P is not changed at a certain period, when the roll body R is determined to be unmoved, driving of the roll motor 51 is finished.

Specifically, during driving the roll motor 51, the roll motor control portion 84 regularly performs an interrupt process (for example, every 1 millisecond). In the interrupt process, first, a current count value Cc is acquired from the roll rotation detecting portion 53. Also, as described in Expression (3), the rotation position P of the roll body R in the rewinding direction is acquired (detected) by subtracting the obtained current count value Cc from a count value Cs at the time of starting the looseness removing process, which is obtained from the roll rotation detecting portion 53.

$$P = Cc - Cs \tag{3}$$

As described above, the "rotation position detecting portion" is provided with the roll rotation detecting portion 53 and the roll motor control portion 84.

If the rotation position P is acquired, it is determined whether or not a maximum value of the rotation position P including the acquired rotation position P is the same value as a maximum value of the rotation position P in a previous interrupt process. The maximum value of the rotation position P is a maximum value of all rotation positions P, which are acquired during the looseness removing process at that time. In addition, the determination is performed, at the time of first interrupt process, as a maximum value of the rotation position P in the previous interrupt process is set to "zero".

As a result of the determination, in a case in which the maximum value of the rotation position P is determined to be the same value as that of the previous process, in a plurality of times of the interrupt process including this interrupt process, continuously, it is determined whether or not the number of times, when the maximum value is determined to be the same as that of the previous process, is a certain number of times n (n≥2) or more. Also, in a case in which the number of times is determined to be equal to or more than a certain number of times n, the detected rotation position P is not changed at a certain period, the roll body R is determined to be unmoved, and driving of the roll motor 51 is finished.

Figure 5:
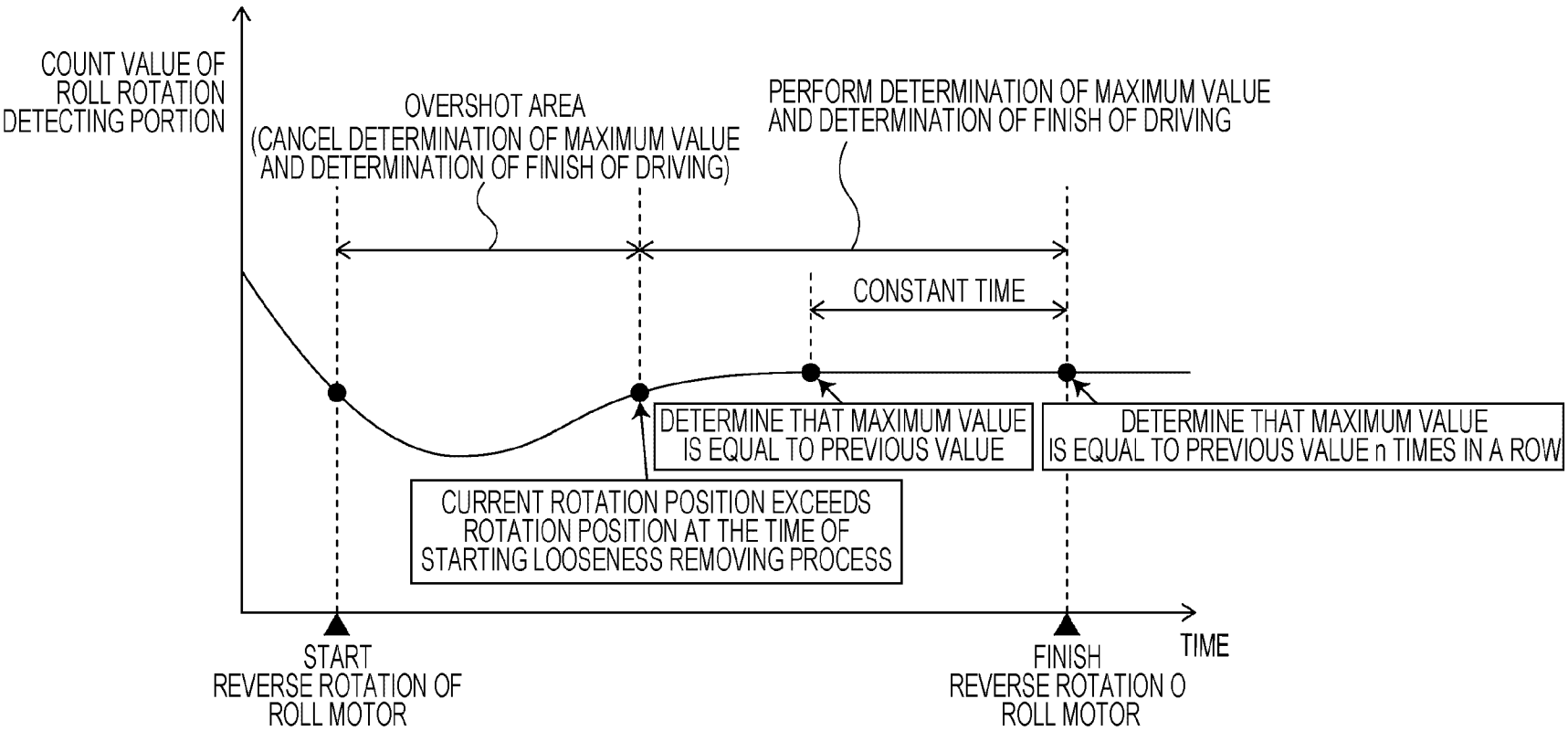
FIG. 5 is a graph illustrating a modification example of the looseness removing process.

Moreover, as illustrated in FIG. 5, in a case in which the looseness removing process is continuously performed in the line feed operation, at the time of starting the looseness removing process (at the time of starting reversely rotation and driving of the roll motor 51), the roll body R is being rotated in the unwinding direction. Under consideration of this case, as illustrated in the FIG. 5, in the rewinding direction, at a timing when the rotation position P of the roll body R exceeds the rotation position P at the time of starting the looseness removing process, determination of the maximum value of the rotation position P (determining whether or not the maximum value is the same as that of the previous process) and determination of finish of driving (the number of times of determining whether or not the maximum value is the same as that of the previous process is equal to or more than a certain number of times n) may be started. Specifically, an area from starting the looseness removing process until the rotation position P of the roll body R in the rewinding direction exceeds the rotation position P at the time of starting the looseness removing process, is set to an overshot area, and on the overshot area, in the interrupt process, determination of the maximum value of the rotation position P and determination of finish of driving are canceled.

According to this configuration, even the roll body R is rotated in the unwinding direction at the time of starting the looseness removing process due to an influence of the right before line feed operation, after the influence of rotation in the unwinding direction disappears, the determination of the maximum value of the rotation position P and the determination of finish of driving can be started. That is, at the time of rotation in the unwinding direction or rewinding as unwinding, there is a possibility that a situation in which the maximum value of the rotation position P in the rewinding direction is not updated is generated. Therefore, at this time, when the determination of the maximum value of the rotation position P and the determination of finish of driving are performed, the maximum value of the rotation position P is determined to be same as the value of the previous process, and the roll body R is erroneously determined to be unmoved, but according to the configuration, such an erroneous determination can be avoided.

Hitherto, according to the embodiment, in the looseness removing process, since driving of the roll motor 51 is finished on the basis of movement of the rotation position P of the roll body R as a trigger, looseness of the printing medium A disappears, and driving of the roll motor 51 can be finished at the timing of not rotating the roll body R. Accordingly, the situation in which the roll motor 51 is continuously driving of more than necessary can be avoided, and thus heat generation of the roll motor 51 can be suppressed as much as possible. Therefore, a situation in which temperature of the roll motor 51 exceeds allowable temperature can be avoided as much as possible. In addition, heat generation of the roll motor 51 can be suppressed as much as possible, and thus the roll motor 51 having low allowable temperature can be used.

In addition, when determination is performed using the maximum value of the rotation position P without using the rotation position P as it is, a situation in which erroneous determination is generated due to an influence of hunting can be avoided.

Further, since the looseness removing process is performed in every line feed operation, the line feed operation of each time can be accurately performed.

Moreover, in the embodiment, a value obtained from the roll rotation detecting portion 53 is used as it is as the count value Cs at the time of starting the looseness removing process, but a value obtained from the roll rotation detecting portion 53 is corrected (offset) by only a predetermined offset value, and it may be used as the count value Cs at the time of starting the looseness removing process. For example, an offset value in accordance with a looseness amount of the printing medium A may be added to a value obtained from the roll rotation detecting portion 53.

In addition, in the embodiment described above, when it is determined that the rotation position P of the roll body R is not changed at a certain time, driving of the roll motor 51 is finished, but in the interrupt process, driving of the roll motor 51 may be finished at a timing when the rotation position P of the roll body R is not changed. In addition, at a timing when it is determined that an amount of changing of the rotation position P of the roll body R is equal to or smaller than a certain amount, driving of the roll motor 51 may be finished, and at the timing when it is determined that a state in which an amount of changing of the rotation position P of the roll body R is equal to or smaller than a certain amount is continued at a certain time, driving of the roll motor 51 may be finished.

Moreover, under consideration that plus and minus of a count value obtained by the roll rotation detecting portion 53 are reversed, due to whether or not the roll body R is an outer winding media, or an inner winding media, in the embodiment described above, an absolute value of the acquired rotation position P may be used. That is, the absolute value of the acquired rotation position P may be used for determination of the overshot area or calculation and determination of the maximum value.

Moreover, in the embodiment described above, the invention is applied for a printing apparatus (large format printer 1) which performs printing on the printing medium A being fed by the medium feeding mechanism 11, but it is not limited thereto. That is, the invention may be applied for a medium processing apparatus which performs process other than printing on the medium being fed by the medium feeding mechanism 11.

This application claims priority under 35 U.S.C. § 119 to Japanese Patent Application No. 2016-070420, filed Mar. 31, 2016. The entire disclosure of Japanese Patent Application No. 2016-070420 is hereby incorporated herein by reference.

What is claimed is:

1. A medium feeding apparatus comprising:

a holding portion that holds a roll body around which a medium is wound;

a medium feeding portion that pulls out the medium from the roll body and feeds the medium;

a roll motor that rotates the roll body held by the holding portion;

a control portion that controls the roll motor; and a rotation position detecting portion that detects a rotation position of the roll body, wherein the control portion performs removing looseness of the medium pulled out from the roll body by driving the roll motor and rotating the roll body in a rewinding direction, wherein, in the removing, the control portion determines for a current interrupt period whether the rotation position equals a maximum rotation position, the maximum rotation position being a rotation position of one or more previous interrupt periods, and wherein when the rotation position equals the maximum rotation position, the control portion further determines a number of times that the rotation position continues to equal the maximum rotation position, and wherein, in the removing, driving of the roll motor is finished on the basis of movement of the rotation position detected by the rotation position detecting portion.

2. The medium feeding apparatus according to claim 1, wherein, in the removing, determination whether or not the roll body is unmoved is made by the movement of the rotation position, and when the roll body is determined to be unmoved, driving of the roll motor is finished.

3. The medium feeding apparatus according to claim 2, wherein, in the removing, when a maximum value of the detected rotation position is not changed at a certain time, the roll body is determined to be unmoved.

4. A printing apparatus comprising:

the medium feeding apparatus according to claim 3; and a printing portion that performs printing on a medium being fed by the medium feeding apparatus.

5. The printing apparatus according to claim 4, wherein the control portion performs removing in every line feed operation.

6. The medium feeding apparatus according to claim 2, wherein, in the removing, determination whether or not the roll body is unmoved starts when the current rotation position of the roll body exceeds the rotation position at the time of starting the removing in the rewinding direction.

7. A printing apparatus comprising:

the medium feeding apparatus according to claim 6, and a printing portion that performs printing on a medium being fed by the medium feeding apparatus.

8. The printing apparatus according to claim 7, wherein the control portion performs removing in every line feed operation.

9. A printing apparatus comprising:

the medium feeding apparatus according to claim 2; and a printing portion that performs printing on a medium being fed by the medium feeding apparatus.

10. The printing apparatus according to claim 9, wherein the control portion performs removing in every line feed operation.

11. A printing apparatus comprising:

the medium feeding apparatus according to claim 1; and a printing portion that performs printing on a medium being fed by the medium feeding apparatus.

12. The printing apparatus according to claim 11, wherein the control portion performs removing in every line feed operation.

13. A control method of a medium feeding apparatus which includes a holding portion that holds a roll body around which a medium is wound, a medium feeding portion that pulls out the medium from the roll body and feeds the medium, and a roll motor that rotates the roll body held by the holding portion, the method comprising:

removing the looseness of the medium pulled out from the roll body by driving the roll motor and rotating the roll body in a rewinding direction, and finishing driving of the roll motor based on movement of a rotation position of the roll body in the removing, wherein, in the removing, the control portion determines for a current interrupt period whether the rotation position equals a maximum rotation position, the maximum rotation position being a rotation position of one or more previous interrupt periods, and wherein when the rotation position equals the maximum rotation position, the control portion further determines a number of times that the rotation position continues to equal the maximum rotation position.

* * * * *